US008317138B1

(12) United States Patent
Johnson, Jr.

(10) Patent No.: US 8,317,138 B1
(45) Date of Patent: Nov. 27, 2012

(54) EATING UTENSIL HOLDER CLIP

(76) Inventor: Robert E. Johnson, Jr., Saint George, UT (US)

( * ) Notice: Subject to any disclaimer, the term of this patent is extended or adjusted under 35 U.S.C. 154(b) by 357 days.

(21) Appl. No.: 12/687,332

(22) Filed: Jan. 14, 2010

(51) Int. Cl.

| | |
|---|---|
| ***A47G 21/14*** | (2006.01) |
| ***A47G 1/10*** | (2006.01) |
| ***A47F 5/00*** | (2006.01) |
| ***F16L 3/08*** | (2006.01) |
| ***A45C 11/26*** | (2006.01) |

(52) U.S. Cl. ..... 248/37.6; 248/316.7; 248/309.1; 248/346.03; 248/74.2; 248/37.3; 206/349; 211/70.1; 211/88.01; 211/89.01

(58) Field of Classification Search ..... 248/37.6, 248/316.7, 309.1, 346.03, 74.2, 37.3; 206/349; 211/70.7, 88.01, 89.01
See application file for complete search history.

(56) References Cited

U.S. PATENT DOCUMENTS

| | | | | | |
|---|---|---|---|---|---|
| 1,125,585 | A | * | 1/1915 | Menger | 220/735 |
| 1,237,504 | A | * | 8/1917 | Graham | 248/37.3 |
| 1,769,803 | A | * | 7/1930 | Myers | 248/37.6 |
| 2,530,470 | A | * | 11/1950 | Kenly | 248/37.6 |
| 2,739,465 | A | * | 3/1956 | Soderblom | 248/37.6 |
| 2,919,086 | A | * | 12/1959 | McMahan | 248/37.6 |
| 4,175,306 | A | * | 11/1979 | Bigelow et al. | 24/507 |
| 4,413,379 | A | * | 11/1983 | Evans | 24/3.11 |
| 4,632,347 | A | * | 12/1986 | Jurgich | 248/213.2 |
| D293,756 | S | | 1/1988 | Benson | |
| 5,222,622 | A | | 6/1993 | Laske, Jr. | |
| 5,730,405 | A | * | 3/1998 | Nichols, IV | 248/213.2 |
| 5,823,483 | A | * | 10/1998 | Gaskill | 248/37.6 |
| 6,502,283 | B1 | * | 1/2003 | Aguirre | 24/3.11 |
| 7,077,302 | B2 | * | 7/2006 | Chuang | 224/420 |
| 7,217,031 | B2 | * | 5/2007 | Bhavnani | 368/316 |
| 7,513,472 | B2 | * | 4/2009 | Yang | 248/231.81 |

* cited by examiner

*Primary Examiner* — Terrell McKinnon
*Assistant Examiner* — Christopher Garft

(57) ABSTRACT

An eating utensil holder clip which attaches to a plate without scratching the surface of the plate, provides slots within an upper section formed of dense foam into which various eating utensils are removably disposed, and holds the utensils in a horizontal balanced position relative to the plate to prevent slippage of the utensils from the slots.

16 Claims, 3 Drawing Sheets

EATING UTENSIL HOLDER CLIP

BACKGROUND OF THE INVENTION

Various types of utensil holders are known in the prior art. However, what is needed is an eating utensil holder clip which attaches to a plate without scratching the surface of the plate, provides slots into which various eating utensils are removably disposed, and holds the utensils in a horizontal position relative to the plate to further prevent slippage of the utensils from the slots.

FIELD OF THE INVENTION

The present invention relates to a utensil holder, and more particularly, to an eating utensil holder clip which attaches to a plate without scratching the surface of the plate, provides slots into which various eating utensils are removably disposed, and holds the utensils in a horizontal position relative to the plate to further prevent slippage of the utensils from the slots.

SUMMARY OF THE INVENTION

The general purpose of the present eating utensil holder clip, described subsequently in greater detail, is to provide an eating utensil holder clip which has many novel features that result in an eating utensil holder clip which is not anticipated, rendered obvious, suggested, or even implied by prior art, either alone or in combination thereof.

To accomplish this, the present eating utensil holder clip is used in combination with at least one eating utensil and a plate having a perimeter. The eating utensil holder clip removably attaches to the perimeter of the plate. The eating utensil holder clip includes an elongated bottom portion, a holder base, and a spring therebetween by which the holder clip is selectively placed into an open position. The bottom portion has a generally rectangular bottom side, a generally rectangular upper side opposite the bottom side, the upper side having a right side and a left side, a parallelepiped lower lip upwardly disposed form the bottom side on each of the left side and the right side. A plurality of first protrusions is centered along an upper edge of each of the lower lips. The first protrusions extend partially over the upper side The holder base includes an upper section and a lower section. The lower section incorporates a lower portion having a bottom edge, a top edge, a back edge, a forward edge, and opposite side edges. The lower portion also includes a continuous parallelepiped upper lip downwardly disposed from a lower edge of each of the side edges. Each of the upper lips is aligned with an opposite one of the lower lips. The lower portion further includes a plurality of second protrusions centered along a lower edge of each of the upper lips. The second protrusions partially cover the bottom edge. The upper portion of the lower section has a bottom wall, a front wall, a rear wall and a pair of side walls. The lower portion is centered within the upper portion. The top edge of the lower portion has an area smaller than the area of the upper portion bottom wall.

A C-shaped spring is disposed between the bottom portion and the lower portion bottom edge of the holder base.

The upper section of the holder base includes a plurality of spaced-apart slots continuously running from the right wall through the left wall which removably secures an eating utensil. The present eating utensil holder clip also provides a rubberized first covering and a second covering which cover the bottom portion front edge and the lower portion front wall to prevent the clip from scratching a plate. Several concentric concave indents disposed on the upper wall of the upper section provide a non-slip area upon which a user presses his thumb to place pressure on the spring to open the holder clip. A logo may also be disposed on the holder clip, including on the upper wall near the indents.

The bottom portion may be constructed of hard plastic. The lower section of the holder base may be formed of polystyrene, wood or other suitable materials which will further the purposes of the present holder clip. The upper section of the holder base may be formed of a dense foam material, which may include memory foam. In addition, the eating utensil holder clip has a height in a range of about 7/16 inch to about ½ inch and a width of about 1¼ inches. These dimensions allow the clip holder to properly secure the eating utensils while maintaining balance when the clip holder is attached to a plate.

Thus has been broadly outlined the more important features of the present eating utensil holder clip and method so that the detailed description thereof that follows may be better understood and in order that the present contribution to the art may be better appreciated.

Numerous objects, features and advantages of the present eating utensil holder clip will be readily apparent to those of ordinary skill in the art upon reading the following detailed description of presently preferred, but nonetheless illustrative, examples of the present eating utensil holder clip and method when taken in conjunction with the accompanying drawings. In this respect, before explaining the current examples of the present eating utensil holder clip and method in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the eating utensil holder clip and method. It is therefore important that the claims be regarded as including such equivalent constructions insofar as they do not depart from the spirit and scope of the present invention.

Objects of the present eating utensil holder clip and method, along with various novel features that characterize the invention are particularly pointed out in the claims forming a part of this disclosure. For better understanding of the eating utensil holder clip and method, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
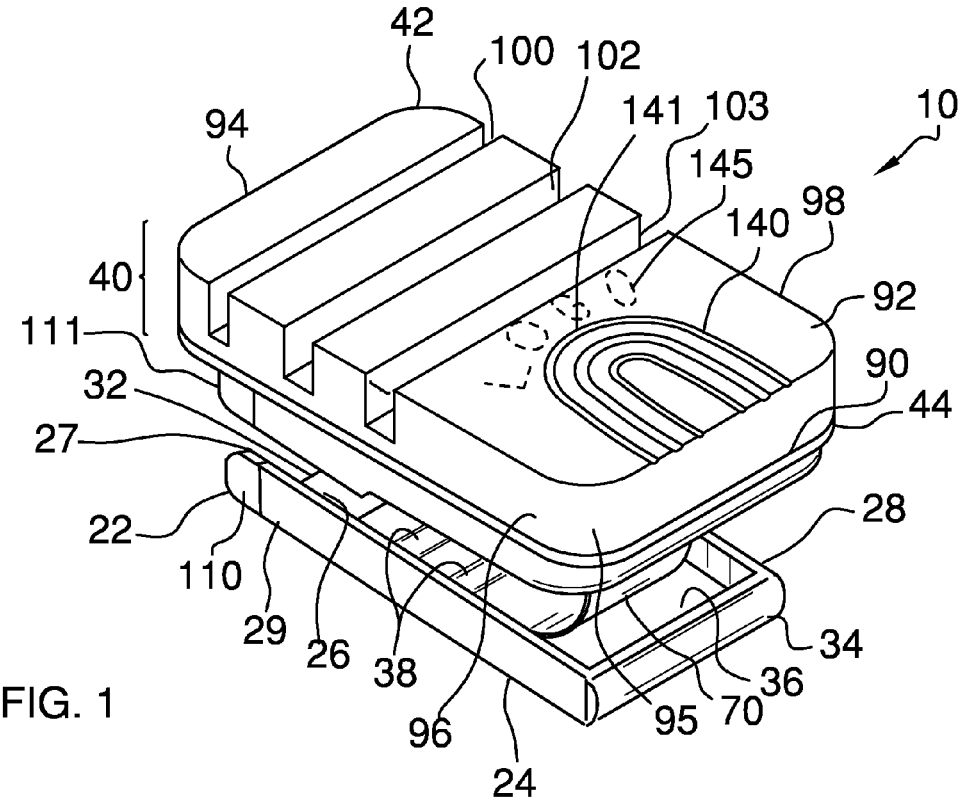
FIG. 1 is an isometric view.
Figure 2:
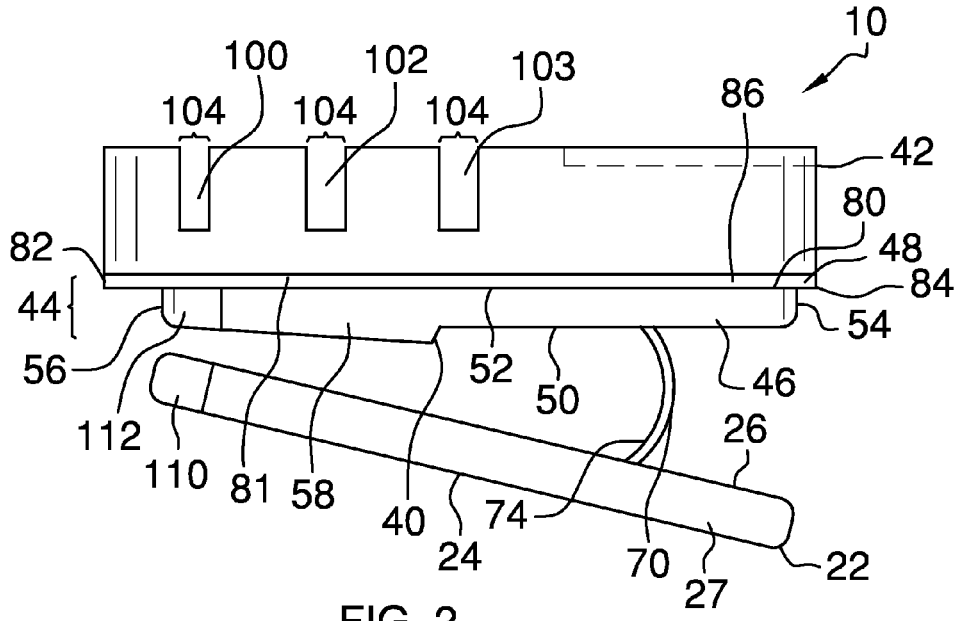
FIG. 2 is a right elevation view, the opposite side being a mirror image of the shown.
Figure 3:
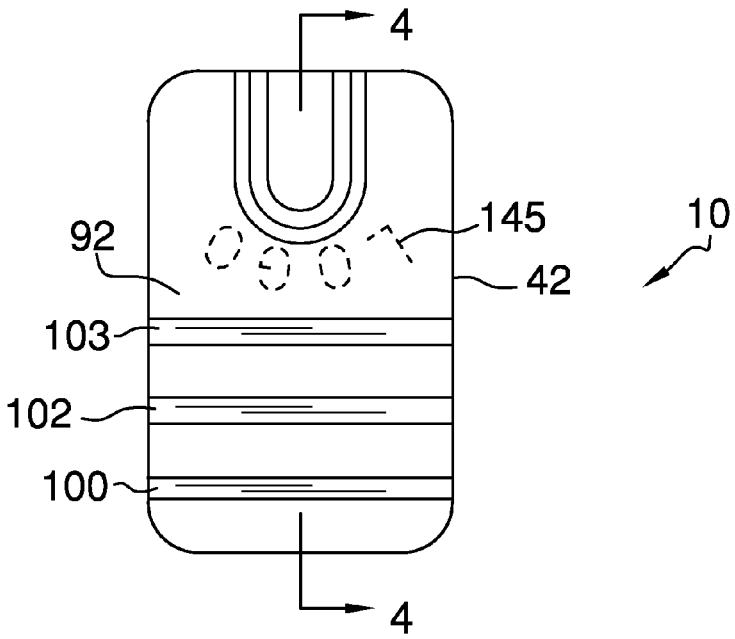
FIG. 3 is a top plan view.
Figure 4:
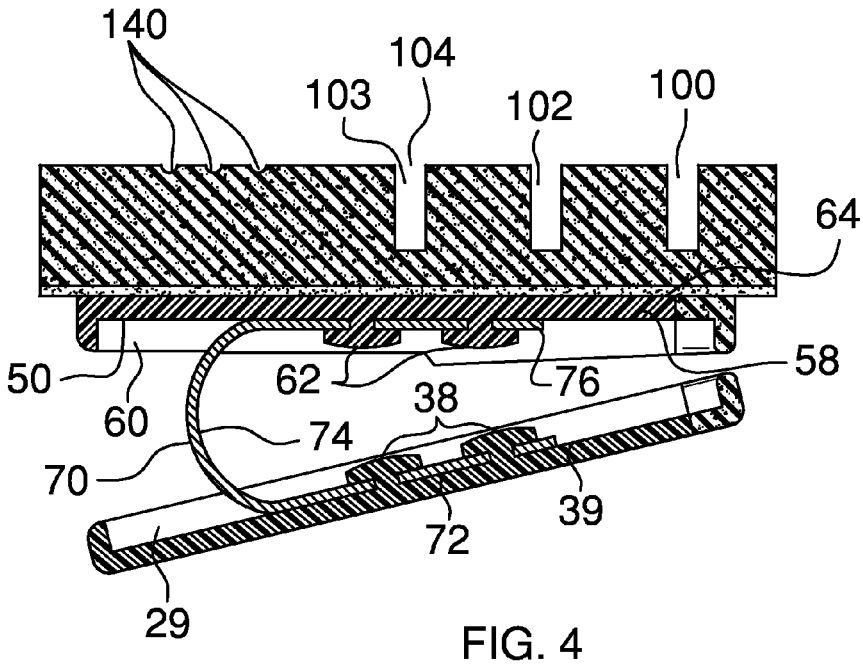
FIG. 4 is a cross-section view taken along line 4-4 of FIG. 3.
Figure 5:
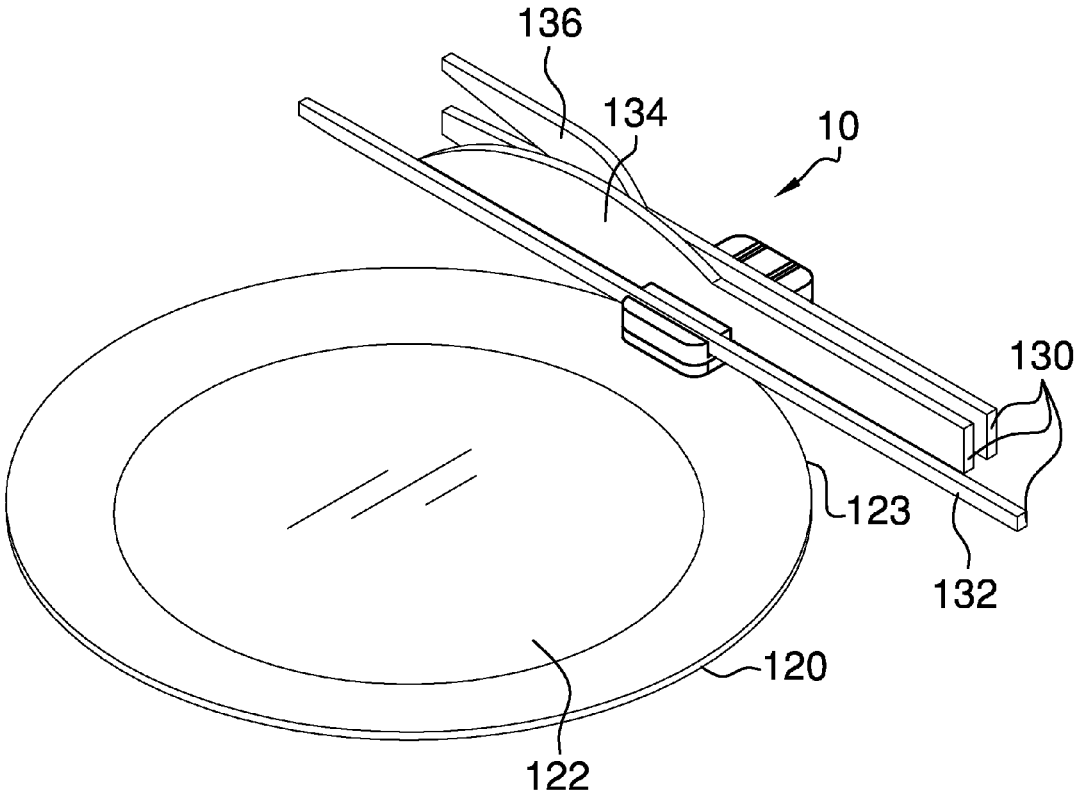
FIG. 5 in an in-use view illustrating the present clip attached to a plate.

With reference now to the drawings, and in particular FIGS. 1 through 5 thereof, example of the instant eating utensil holder clip employing the principles and concepts of the present eating utensil holder clip and generally designated by the reference number 10 will be described.

Referring to FIGS. 1 through 5, the present eating utensil holder clip 10 is illustrated. The eating utensil holder clip 10 is used in combination with at least one eating utensil 130 and a plate 120 having a perimeter 123. The eating utensil holder clip 10 removably attaches to the perimeter 123 of the plate 120.

The eating utensil holder clip 10 includes an elongated bottom portion 22, a holder base 40, and a spring 70 therebetween. The bottom portion 22 has generally rectangular bottom side 24, a generally rectangular upper side 26 opposite the bottom side 24, the upper side 26 having a right side 27 and a left side 28. A parallelepiped lower lip 29 is upwardly disposed from the bottom side 24 on each of the right side 27 and the left side 28. A plurality of first protrusions 38 is disposed along an upper edge 39 of each of the lower lips 29. The first protrusions 38 extend partially over the upper side 26.

The holder base 40 includes an upper section 42 and a lower section 44. The lower section 44 incorporates a lower portion 46 and an upper portion 48. The lower portion 46 and the upper portion 48 may be molded together. The lower portion 46 has a bottom edge 50, a top edge 52, a back edge 54, a forward edge 56, and opposite side edges 58. The lower portion 46 also includes a continuous parallelepiped upper lip 60 downwardly disposed from the bottom edge 50 along each of the side edges 58. Each of the upper lips 60 is aligned with an opposite one of the lower lips 29. The lower portion 46 further includes a plurality of second protrusions 62 centered along each of the upper lips 60. The second protrusions 62 partially cover the bottom edge 50. The upper portion 48 of the lower section 44 has a bottom wall 80, a top wall 81, a front wall 82, a rear wall 84, and a pair of side walls 86. The lower portion 46 is disposed within the upper portion 48. The top edge 52 of the lower portion 46 has an area smaller than the area of the upper portion 48 bottom wall 80.

A spring 70 is disposed between the bottom portion 22 and the lower portion 46 bottom edge 50 of the holder base 40. The spring 70 includes a flat rectangular bottom section 72 disposed between the upper side 26 and the first protrusions 38 of the bottom portion 22 between the right side 27 and the left side 28, a concave midsection 74 and a flat rectangular top section 76 disposed between the bottom edge 50 and the second protrusions 62 between the right edge 27 and the left edge 28.

The upper section 42 of the holder base 40 includes a lower wall 90 attached to the top wall 81 of the lower section 44 upper portion 48, an upper wall 92 opposite the lower wall 90, a forward wall 94, a rearward wall 95 opposite the forward wall 94, a right wall 96 between the forward wall 94 and the rearward wall 95, a left wall 98 opposite the right wall 96, and a plurality of spaced-apart slots 100, 102, 103. Each slot 100, 102, 103 has a rectangular cross-section. The slots 100, 102, 103 run continuously from the right wall 96 through the left wall 98. Each of the slots 100, 102, 103 has an open edge 104 disposed on the upper section 42 upper wall 92. Each of the slots 100, 102, 103 removably secures an eating utensil 130. The slots 100, 102, 103 may include a first slot 100, a second slot 102, and a third slot 103. Each consecutive one of the first slot 100, the second slot 102, and the third slot 103 is disposed farther away from the forward wall 94. The first slot 100, the second slot 102, and the third slot 103 may have identical dimensions or one of the first slot 100, the second slot 102, and the third slot 103 may be narrower than the other two slots.

The present eating utensil holder clip 10 also provides a rubberized first covering 110 disposed over the front edge 32, about one-third of the bottom side 24 adjacent to the front edge 32, and about one-third of the upper side 26 adjacent to the front edge 32. A second covering 111 identical to the first covering 110 is disposed over the front wall 82, about one-third of the bottom edge 50 adjacent to the front wall 82, and about one-third of the top edge 52 adjacent to the front wall 82. The first covering 110 and the second covering 111 prevent the present holder clip 10 from scratching a plate 120 when the holder clip 10 is attached to the plate 120.

Also, a plurality of concentric concave indents 140 are disposed on the upper wall 92 near the forward wall 94 of the upper section 42. The indents 140 provide a non-slip area upon which a user presses his thumb to place pressure on the spring 70 to place the holder clip 10 in an open position in order to removably secure the holder clip 10 to a plate 120. Each indent 140 has an apex 141 which is disposed nearer the first slot 100 than to the forward wall 94.

A logo 145 may be disposed on the holder clip 10. The logo 145 may be disposed on the upper wall 92 of the upper section 42 of the holder base 40 and further the logo 145 may be disposed between the apex 141 and the first slot 100.

The bottom portion 22 may be constructed of hard plastic. The lower section 44 of the holder base 40 may be formed of polystyrene, wood or other suitable materials which will further the purposes of the present holder clip 10. The upper section 42 of the holder base 40 may be formed of a dense foam material, which may include memory foam.

In addition, the eating utensil holder clip 10 has a height in a range of about 7/16 inch to about ½ inch and a width of about 1¼ inches. These dimensions allow the clip holder 10 to properly secure the eating utensils 130 while maintaining balance when the clip holder 10 is attached to a plate 120. The eating utensils 130 may include a chopstick 132, a knife 134 and a fork 136 as shown.

With respect to the above description then, it is to be realized that the optimum dimensional relationships for the parts of the present eating utensil holder clip to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An eating utensil holder clip in combination with at least one eating utensil and a plate having a perimeter, the eating utensil holder clip comprising:

an elongated bottom portion comprising a generally rectangular bottom side;

a generally rectangular upper side opposite the bottom side, the upper side having a right side and a left side;

a parallelepiped lower lip upwardly disposed from the bottom side on each of the right side and the left side;

a plurality of first protrusions disposed along an upper edge of each of the lower lips, the first protrusions extending partially over a portion of the upper side;

a holder base comprising an upper section;

a lower section further comprising a lower portion having a bottom edge, a top edge, a back edge, a forward edge, and opposite side edges, the lower portion comprising a continuous parallelepiped upper lip downwardly disposed from a lower edge of each of the side edges, each of the upper lips aligned with an opposite one of the lower lips;

a plurality of second protrusions centered along each of the upper lips, the second protrusions partially covering the bottom edge;

an upper portion of the lower section, the upper portion having a bottom wall, a top wall, a front wall, a rear wall, and a pair of side walls, the lower portion disposed within the upper portion, wherein the top edge of the lower portion has an area smaller than the area of the upper portion bottom wall;

a spring disposed between the bottom portion and the lower portion bottom edge of the holder base, the spring comprising a flat rectangular lower section disposed between the upper side and the first protrusions of the bottom portion between the right side and the left side;

a concave midsection;

a flat rectangular top section disposed between the bottom edge and the second protrusions between the right edge and the left edge;

an upper section comprising a lower wall attached to the top wall of the bottom section upper portion;

an upper wall opposite the lower wall;

a forward wall;

a rearward wall opposite the forward wall;

a right wall between the forward wall and the rearward wall;

a left wall opposite the right wall;

a plurality of spaced-apart slots, each slot having a rectangular cross-section, the slots running continuously from the right wall through the left wall, an open edge of each of the slots, the open edge disposed on the upper section upper wall;

a rubberized first covering disposed over the front edge, about one-third of the bottom side adjacent to the front edge, and about one-third of the top side adjacent to the front edge;

a second covering identical to the first covering disposed over the front wall, about one-third of the bottom edge adjacent to the front wall, and about one-third of the top edge adjacent to the front wall;

wherein the slots removably secure the eating utensil;

wherein the eating utensil holder clip removably attaches to a perimeter of the plate.

2. The eating utensil holder clip of claim 1 further comprising a plurality of concentric concave indents disposed on the upper wall near the forward wall of the upper section;

an apex of each indent, the apex disposed nearer the first slot than to the forward wall;

wherein the indents form a non-slip area;

further wherein the indents receive pressure whereupon such pressure places the holder clip in an open position.

3. The eating utensil holder clip of claim 2 wherein the plurality of slots comprises a first slot, a second slot, and a third slot, each consecutive one of the first slot, the second slot, and the third slot disposed farther away from the forward wall.

4. The eating utensil holder clip of claim 3 wherein the first slot, the second slot and the third slot have identical dimensions.

5. The eating utensil holder clip of claim 4 wherein the holder base is formed of polystyrene.

6. The eating utensil holder clip of claim 4 wherein the holder base is formed of wood.

7. The eating utensil holder clip of claim 5 wherein the eating utensil holder clip has a height in a range of about 7/16 inch to about ½ inch and a width of about 1¼ inches.

8. The eating utensil holder clip of claim 6 wherein the eating utensil holder clip has a height in a range of about 7/16 inch to about ½ inch and a width of about 1¼ inches.

9. The eating utensil holder clip of claim 7 wherein the upper section of the holder base is formed of dense foam.

10. The eating utensil holder clip of claim 8 wherein the upper section of the holder base is formed of dense foam.

11. An eating utensil holder clip in combination with at least one eating utensil and a plate having a perimeter, the eating utensil holder clip comprising:

an elongated bottom portion comprising a generally rectangular bottom side;

a generally rectangular upper side opposite the bottom side, the upper side having a right side and a left side;

a parallelepiped lower lip upwardly disposed from the bottom side on each of the left side and the right side;

a plurality of first protrusions disposed along an upper edge of each of the lower lips, the first protrusions extending partially over a portion of the upper side;

a holder base comprising an upper section;

a lower section further comprising a lower portion having a bottom edge, a top edge, a back edge, a forward edge, and opposite side edges, the lower portion comprising a continuous parallelepiped upper lip downwardly disposed from a lower edge of each of the side edges, each of the upper lips aligned with an opposite one of the lower lips;

a plurality of second protrusions centered along a lower edge of each of the upper lips, the second protrusions partially covering the bottom edge;

an upper portion of the bottom section, the upper portion having a bottom wall, a front wall, a rear wall, and a pair of side walls, lower portion disposed within the upper portion, wherein the top edge of the lower portion has an area smaller than the area of the upper portion bottom wall;

a spring disposed between the bottom portion and the lower portion bottom edge of the holder base, the spring comprising a flat rectangular lower section disposed between the upper side and the first protrusions of the bottom portion between the right side and the left side;

a concave midsection;

a flat rectangular upper section disposed between the bottom edge and the second protrusions between the right edge and the left edge;

an upper section comprising a lower wall attached to the top wall of the bottom section upper portion;

an upper wall opposite the lower wall;

a forward wall;

a rearward wall opposite the forward wall;

a right wall between the forward wall and the rearward wall;

a left wall opposite the right wall;

a plurality of spaced-apart slots, each slot having a rectangular cross-section, the slots running continuously from the right wall through the left wall, an open edge of each the slots, the open edge disposed on the upper section upper wall;

wherein the plurality of slots comprises a first slot, a second slot, and a third slot, each consecutive one of the first slot, the second slot, and the third slot disposed farther away from the forward wall;

wherein the first slot is narrower than the second slot and the third slot;

a rubberized first covering disposed over the front edge, about one-third of the bottom side adjacent to the front edge, and about one-third of the top side adjacent to the front edge;

a second covering identical to the first covering disposed over the front wall, about one-third of the bottom edge adjacent to the front wall, and about one-third of the top edge adjacent to the front wall;

wherein at least one of the first slot, the second slot, and the third slot removably secures the eating utensil; and wherein the eating utensil holder clip removably attaches to a perimeter of the plate.

12. The eating utensil holder clip of claim 11 further comprising:

a plurality of concentric concave indents disposed on the upper wall near the forward wall of the upper section;

an apex of each indent, the apex disposed nearer the first slot than to the forward wall;

wherein the indents form a non-slip area;

further wherein the indents receive pressure whereupon such pressure places the holder clip in an open position.

13. The eating utensil holder clip of claim 12 wherein the eating utensil holder clip has a height in a range of about 7/16 inch to about ½ inch and a width of about 1¼ inches.

14. The eating utensil holder clip of claim 13 wherein the upper section of the holder base is formed of memory foam.

15. The eating utensil holder clip of claim 14 wherein the lower section of the holder base is formed of polystyrene.

16. The eating utensil holder clip of claim 8 wherein the holder base is formed of wood.

* * * * *